United States Patent [19]

Chen

[11] 4,432,551

[45] Feb. 21, 1984

[54] GOLFER'S TRAINING AID

[76] Inventor: Richard M. Chen, 51-25 Goldsmith St., Elmhurst, N.Y. 11373

[21] Appl. No.: 321,572

[22] Filed: Nov. 16, 1981

Related U.S. Application Data

[63] Continuation-in-part of Ser. No. 282,054, Jul. 10, 1981.

[51] Int. Cl.[3] ..... A63B 69/36

[52] U.S. Cl. ..... 273/183 C; 273/186 D; 33/1 C

[58] Field of Search ..... 273/208, 200 R, 183 C, 273/186 D, 33, 32 R, 32 B, 32 C, 32 H, 213; 33/1 C

[56] References Cited

U.S. PATENT DOCUMENTS

| | | | |
|---|---|---|---|
| 676,506 | 6/1901 | Knight et al. | 273/213 |
| 1,783,211 | 12/1930 | Baldwin | 273/33 X |
| 2,033,269 | 3/1936 | Williams | 273/33 X |
| 2,660,436 | 11/1953 | Grossman | 273/186 D |
| 3,506,263 | 4/1970 | Arrington | 273/33 |
| 3,806,132 | 4/1974 | Brandell | 273/183 C X |

*Primary Examiner*—George J. Marlo

*Attorney, Agent, or Firm*—Lackenbach, Siegel, Marzullo, Presta & Aronson

[57] ABSTRACT

A golf alignment marker system is disclosed wherein a calibrated grid is provided on a strip of paper which provides a mark on impact, and the paper is mounted adjacent the golf ball. A golf club strikes the paper and the ball, and a mark is imparted to the paper surface adjacent the grid. In one embodiment an adhesive-backed member or tape is adhered to the ball, and the outer surface of tape is provided with a grid mark and is impact mark sensitive, so that when the club strikes the ball, a mark is imparted to the tape surface at a specific location on the grid. The golfer may then correlate the marked spot with the ball flight. A reader is provided to assist in reading the exact marked spot. The golf alignment marker system of the present invention economically assists the golfer in determining the exact three dimensional orientation of the club face at the moment the ball is struck. One embodiment of the golf ball mark reading device includes a transparent hemispherical member for rotatably receiving a golf ball, wherein the hemisphere is provided with a central marking so that a golf ball with an impact mark caused by the impact of a golf club face can be aligned within the central marking for determination of the club face angle at impact.

8 Claims, 26 Drawing Figures

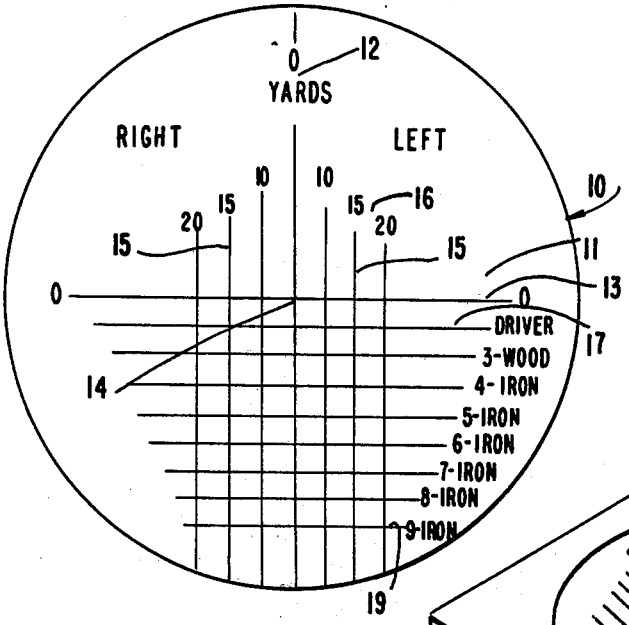
FIG. 1
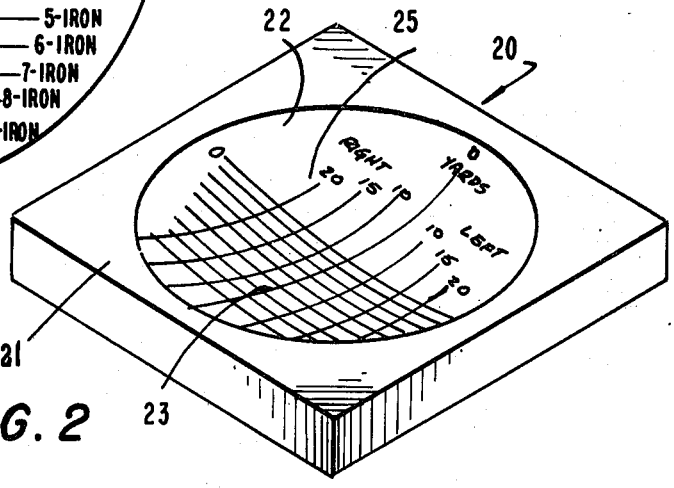
FIG. 2
FIG. 3
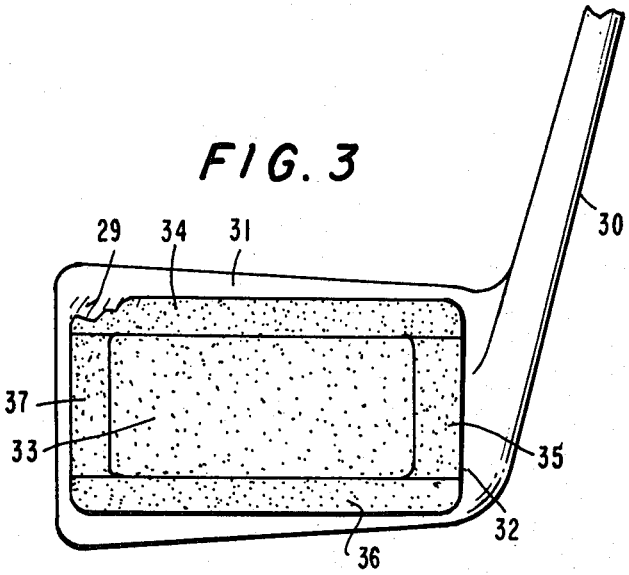
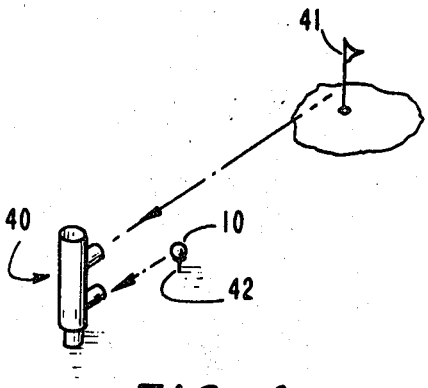
FIG. 4

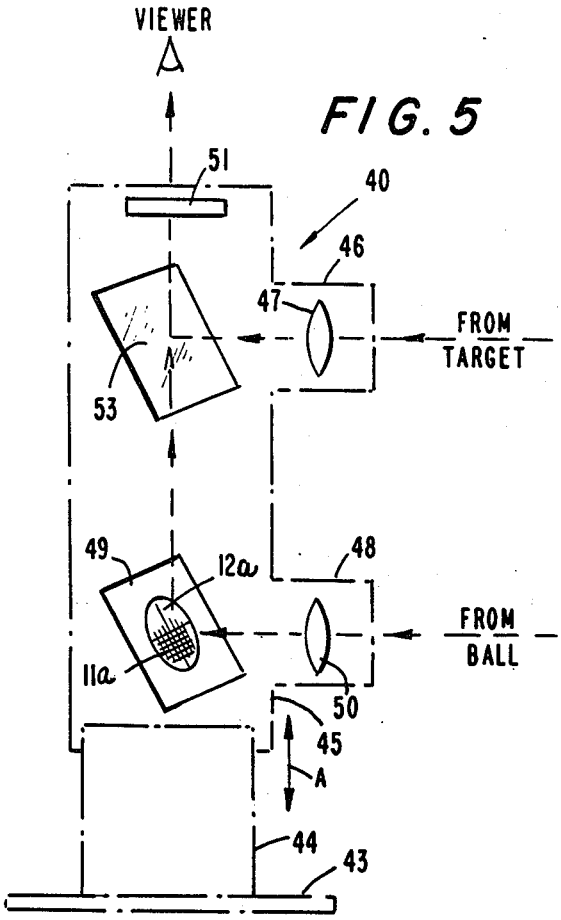
FIG. 5
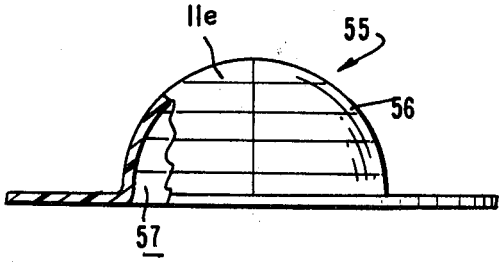
FIG. 7
FIG. 6
| LOFT | STRAIGHT | LEFT | RIGHT |
|---|---|---|---|
| DRIVER | STR. DRAW FADE | DRAW PULL HOOK | FADE PUSH SLICE |
| 5-IRON | STR. | PULL DRAW | PUSH FADE |
| 9-IRON | STR. | PULL | PUSH |

FIG. 9
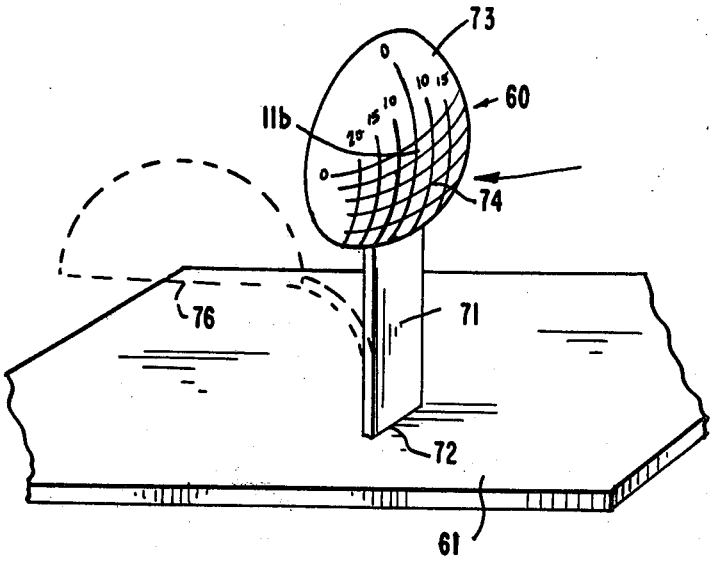
FIG. 8
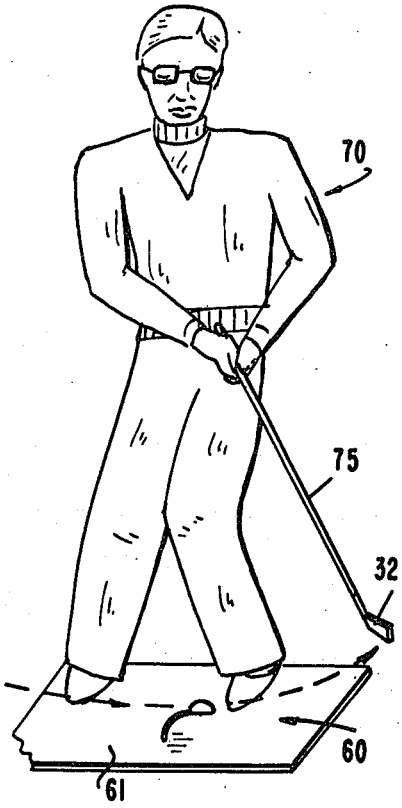
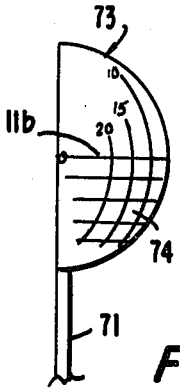
FIG. 10
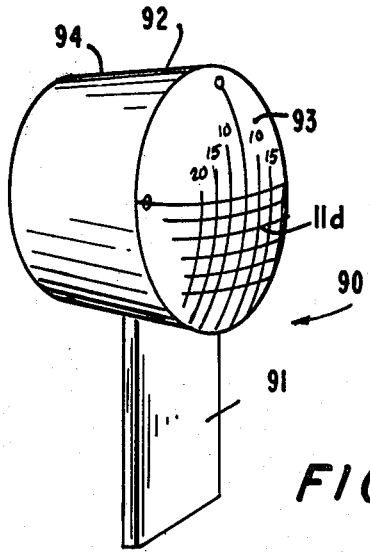
FIG. 11

FIG. 12
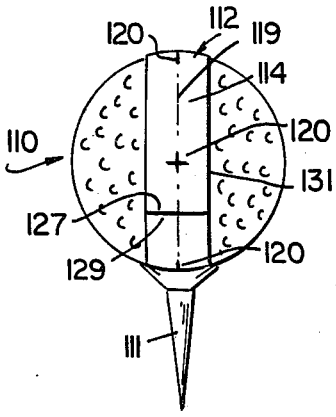
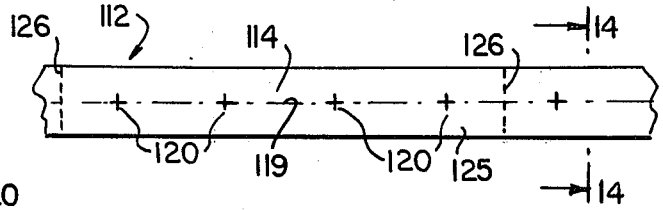
FIG. 13
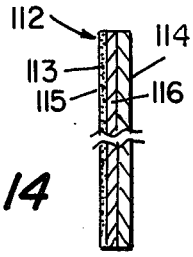
FIG. 14
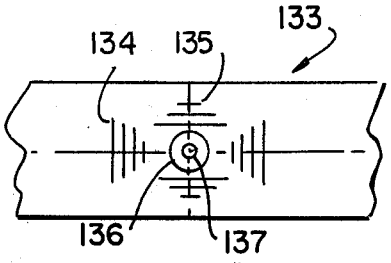
FIG. 15
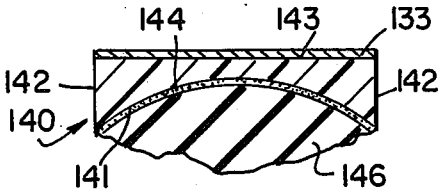
FIG. 16
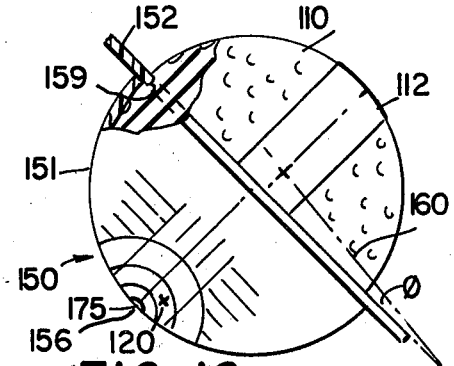
FIG. 18
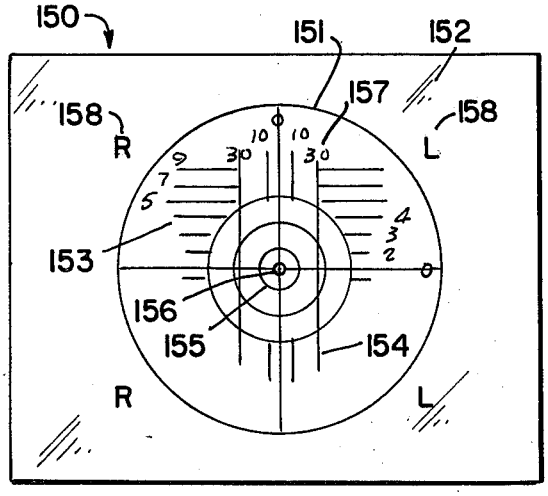
FIG. 17
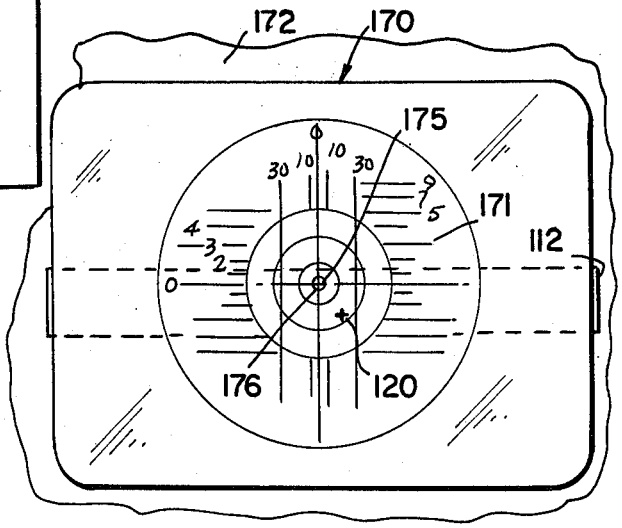
FIG. 19

FIG. 20
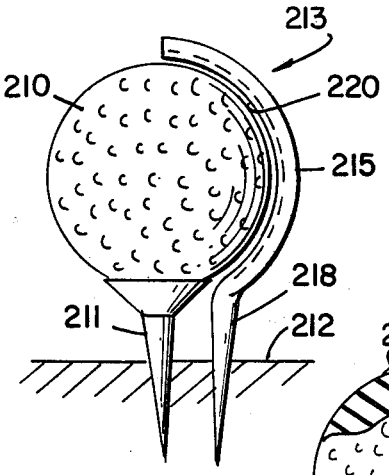
FIG. 21
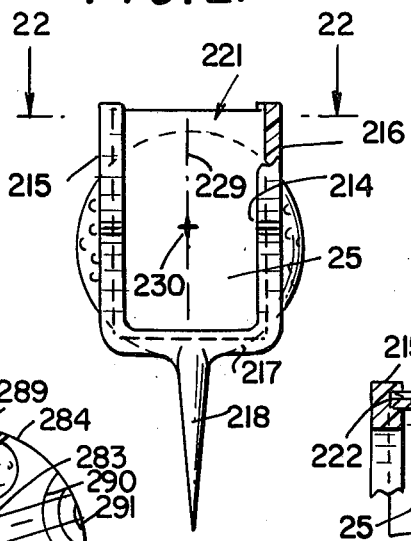
FIG. 22
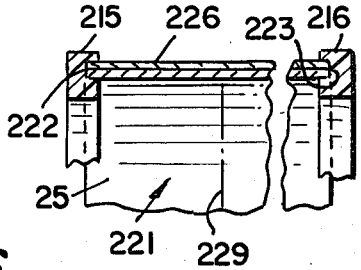
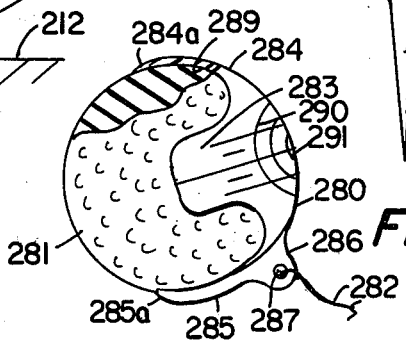
FIG. 26
FIG. 23
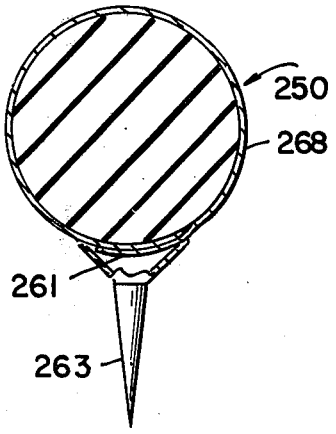
FIG. 24
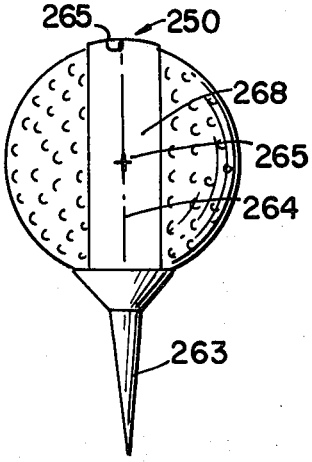
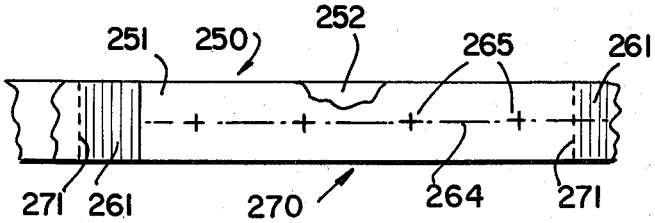
FIG. 25

GOLFER'S TRAINING AID

This application is a continuation-in-part application of my co-pending application, U.S. Ser. No. 282,054, filed July 10, 1981.

FIELD OF THE INVENTION

This invention relates to a golf teaching device and system. Specifically this invention relates to a golf alignment and marker system as an accurate training aid for golfers.

BACKGROUND AND DISCUSSION OF THE PRIOR ART

Heretofore it was known in the prior art to place various markings on a golf ball for alignment with regards to a golf club. Typical of such pior art devices is the equatorial markings as disclosed in Yamamoto, U.S. Pat. No. 4,209,172, granted June 24, 1980, the cross-marking of Fyanes, U.S. Pat. No. 3,325,168, granted June 13, 1967; the ink line of DeVries, U.S. Pat. No. 2,709,595, granted May 31, 1955, and the diffraction markings of Ciccarello, U.S. Pat. No. 4,235,441, granted Nov. 25, 1980.

It was also known in the art to provide diverse sighting devices, such as in Branberg, U.S. Pat. No. 3,729,199; Krupicka, U.S. Pat. No. 4,251,076, granted Feb. 17, 1981; and Zank, U.S. Pat. No. 3,874,672, granted Apr. 1, 1975.

In other aspects, the prior art also recognized marking an adhesive-backed record paper surface by the golf ball-club impact, such as the NCR paper impact marker of Manheck, U.S. Pat. No. 3,754,764, granted Aug. 28, 1973. It was also known to provide double surface stick-ons to a ball, whereon impact with the club, the stick-on is transferred to the club face, as disclosed in U.S. Pat. No. 3,806,132, granted Apr. 23, 1974. Such prior art adhesive-backed construction, suffered the disadvantages of leaving unwanted adhesive on the club face surface and marring the club face surface, as well as being limited to a "sweet-spot" determination, and not to flight correlation data.

It is therefore a principal object of the present invention to provide a novel golf ball alignment marker.

It is another object of the present invention to provide a club marking surface and golf ball alignment device which provides a high degree of accuracy in determining the exact hit location on the golf ball.

It is another object of the present invention to provide a reader to be used with the said alignment marker for accurately determining the strike point on the golf ball.

It is another object of the present invention to provide a means for providing alignment markings in relation to a golf ball.

It is still a further object of the present invention to provide a scope for utilizing the alignment marker system on an actual golf course.

It is a further object of the present invention to determine the club face orientation.

In a further aspect, it is another principal object of the present invention to provide an alignment marker which is readily useful directly with the golf ball in course conditions.

It is another object of the present invention to provide an alignment marker as immediately aforesaid which eliminates adhesive marring of the golf club face.

It is still a further object of the present invention to provide an accurate yet simple reading of the club face orientation.

It is still a further object of the present invention to provide a golf ball attached, multiple use alignment marker.

It is still a further object of the present invention to provide a golf training device utilizing the golf alignment marker, which training device can readily be used indoors.

Another object of the present invention is to provide a golf ball alignment marker which is readily constructed to relatively inexpensive materials and yet practical in design and operation.

BRIEF DESCRIPTION OF THE DRAWINGS

FIG. 1 is a greatly enlarged elevational view of the front face of golf ball showing grid markings embodying the present invention;

FIG. 2 is a perspective view of a device for applying the grid markings as depicted in FIG. 1;

FIG. 3 is a front partial fragmentary view of a golf club utilizing a marking element for use in conjunction with the ball of FIG. 1;

FIG. 4 is a schematic illustration of utilization of the alignment scope and grid marked ball;

FIG. 5 is an elevational schematic illustration of the alignment scope of FIG. 4;

FIG. 6 is a partial view of a reader's chart for interpreting the impact mark on the grid golf ball;

FIG. 7 is a sectional partial fragmentary view of an impact mark locator;

FIG. 8 is a perspective view of a golfer utilizing an alignment marker device pursuant to the present invention;

FIG. 9 is an enlarged perspective view of the device of FIG. 8;

FIG. 10 is an elevational view of the device of FIG. 9;

FIG. 11 is a perspective view of an alternate embodiment of the device of FIGS. 9–10;

FIG. 12 is a side elevational view of a golf ball depicting the tape embodiment of the present invention;

FIG. 13 is a plan view of a tape of the invention of FIG. 12;

FIG. 14 is a partial sectional view of the tape of FIG. 13;

FIG. 15 is a plan view of a modification of the tape of FIG. 12;

FIG. 16 is an adapter modification of the use of the tape of FIG. 15 for high accuracy reading.

FIG. 17 is a modification of the golf mark locator or reader of FIG. 7, in use;

FIG. 18 is a side elevational partial fragmentary view of the reader of FIG. 17;

FIG. 19 is a plan view of a modification of the reader of FIG. 17, in actual use, with the impacted tape of FIG. 12;

FIG. 20 is a side elevational view of a golf ball with a further embodiment of the present invention;

FIG. 21 is a front elevational view of the embodiment of FIG. 20;

FIG. 22 is a fragmentary sectional view taken along line 22—22 of FIG. 21;

FIG. 23 is a side elevational view of a golf ball encompassed by the strip embodiment of the present invention;

FIG. 24 is a front elevational view of the embodiment of FIG. 23;

FIG. 25 is a plan view of the flatened strip embodiment of FIGS. 23 and 24; and

FIG. 26 is a partial fragmentary perspective view of another embodiment of an adapter as in FIG. 16.

DESCRIPTION OF THE PREFERRED EMBODIMENTS

The term "golf ball" as used hereinbefore and hereinafter throughout the specification, shall refer to actual golf balls and those balls which simulate golf balls, such as used in simulators or training devices, or as hereinafter described.

Referring to FIG. 1, there is shown the golf ball of the present invention generally referred to as numeral 10. Ball 10 may be of conventional size and shape with dimples, or may be a practice ball of smooth surface as depicted in FIG. 1. Ball 10 is provided with a plurality of markings 11 which may be permanently imprinted on one hemisphere of the ball. Markings 11 comprise a vertical line 12 and horizontal line 13 which lines lie on the arcs of respective great circles, and are perpendicularly disposed to each other at central cross-mark 14. A plurality of lines 15 are in parallel disposition to veritcal line 12 and disposed on opposite sides of lines 12. The lines are spaced from vertical line 12 and indicate angular deviations from the vertical, and may be marked with specific notations 16. The notations may be angular notations, and also represent yardage deviation for a specific average drive shot distance, such as "5," "10," "15" yards "right" and "left" as seen in FIG. 1. A second plurality of lines 17 are in parallel disposition to and spaced from horizontal line 13. Each such horizontal line represents and contains a lift indication (for the angle of a specific club face) 19 for various golf clubs. Those clubs with the greater angular club face such as the "8-Iron" or "9-Iron" are lower on the ball to indicate the greater degree of lift if the ball is struck properly by that specific club. A specific point on the ball grid will then coincide to a specific vertical and horizontal component, and its deviation with respect to the correct impact point for a certain club, as will be more fully explained hereinafter.

While the marking 11 may be permanently imprinted on the ball, it is also contemplated that a conventional golf ball can be imprinted with the markings. In FIG. 2 there is disclosed a marking device 20 which is formed of a wooden block 21 which is formed with a recess or depression 22 of hemispherical shape. Depression 22 is sized so as to accommodate a conventional golf ball. A plurality of grooves 23 are formed at the bottom of depression 22, which grooves correspond to the markings 11 of ball 10. In this manner of construction, ink by means of a felt marker or swab is spread over the depression surface 25 so as fill grooves 23. The excess ink is wiped from the surface and the surface finish of 25 repels the ink, so that the ink remains in the grooves 23 but not on surface 25. The golf ball 10 is then pressed into the depression to receive the ink from the grooves and the ball allowed to dry. The ball is then ready for use in play.

In utilizing the ball, reference is made to FIG. 3, wherein golf club 30 is shown with club face 31. A chalked pad 32 is adhesively secured to face 31 by pressure sensitive releasable adhesive 29 as is well know in the art. Pad 32 is formed with chalked or inked portions or zones 33–37, representing in seriatim, the central portion 33, the top central portion 34, the right side portion 35, the bottom central portion 36 and the left side portion 37. Each portion or zone is differently colored, namely, black 33, yellow 34, orange 35, red 36 and blue 37. In this manner of construction when the club face strikes the ball a specifically colored mark will be imparted to the ball indicating what portion of the club struck the ball. Pursuant to present invention the imparted mark on the ball will also indicate the angular vertical deviation as well as the lift impact point, thus providing the player with an indication of the deviation from the desired impact point for that club (FIG. 6).

Referring now to FIGS. 4 and 5, there is shown the utilization of scope 40 for insuring proper alignment of the ball with the target 41 and position on tee 42. Scope 40 is formed of base 43, upright mount member 44 and main housing 45. Housing 45 is slidably positionable on support member 44 for adjusting the scope height A in relation to height of the ball on the tee or ground surface. Housing 45 is formed of target scope 46 comprising a lens or lens system 47 for imaging the target or flag pole 41, and a ball scope 48 for imaging ball 10. A half-silver mirror 53 is disposed in housing 45 to receive the target image and in part transport the image to mirror 49. Mirror 49 is permanently imprinted with a replica 11*a* of grid markings 11. Thus, the target image is superimposed on mirror 49, which also receives an image of ball 10 through lens or lens system 50. An eye piece 51 is also provided in the line of sight with angled mirrors 53 and 49. By first adjusting the height of housing 45 so that ball 10 height, or more specifically the ball grid marking height, corresponds to grid 11*a* height, and then rotating the ball so that the grid markings 11 and 11*a* are coincident when viewed in the scope as determined through eye piece 51, and the flag is superimposed vertically on vertical line 12*a*, then it is determine that ball 10 and specifically the markings thereon are true to the horizontal and vertically aligned to the flag pole 41.

In the manner afore-described, the player hits the ball 10 with the club and pad (as in FIG. 3), and the ball flight is noted by the player. On retrieving the ball, the player notes the mark on the ball and determines the impact point, and specifically the deviation from the correct spot or "sweet-spot" for that club and stroke.

Very often the mark on the ball may be larger than the desired single minute spot, and the exact epicenter of the spot would have to be located. To achieve this a transparant plastic hemisphere 55 may be provided. Surface 56 of hemisphere 55 is imprinted with grid markings 11*e* similar to 11 whereby the epicenter of the imparted mark may be located. The deviation reading can then be more accurately determined with the impact point marked ball inserted within hollow 57 of device 55.

Referring to FIG. 6, there is shown a portion of chart 58 which correlates the impact markings with the specific club used the golfer and notations 59 indicate the nature of the deviation to assist.

Referring now to FIGS. 8–10, there is shown a golf training device 60 embodying the present invention. Device 60 comprises a base 61 of sufficient size so that a player 70 can position his body on the base to hold the base down in place. An upright flexible plastic member or tee 71 is fixedly attached to the base 61 at 72 by well known means. An object ball 73 is hemispherically shaped (FIG. 10) having curved surface 74 and is formed of highly impact resistant material, such as Delrin, and the like. A series of grid markings 11*b* are imprinted on surface 74, which marks 11*b* are similar to markings 11 hereinbefore discussed. In use, golfer 70 positions himself on base 61 in relation to object ball 73.

Club 75 is provided with a marking pad 32*a* similar to that hereinbefore described in connection with FIG. 3. Golfer 70 strikes object ball 73 with club 75 and specifically pad 32*a* imparting a chalk mark on surface 74. The object ball or more specifically tee 71 flexes downwardly to position 76 so as to permit a free swinging action as depicted, without impairment of the natural swing of the golfer. The golfer then notes the impact point direction. The ball is then wiped clean, and the golfer tries again in an attempt to correct the swing to reduce the deviation of the impact point from the desired impact point.

Device 60 has the important advantage of being useful in an enclosed environment such as a home or office.

It is also within the contemplation of the present invention to modify the object ball, so that the surface is oblongated such as shown in the device 90 of FIG. 11. Device 90 comprises a base (not shown) and support tee 91, similar to that described in connection with the embodiment of FIGS. 8–10. Object ball 92 comprises a curved oblongated surface 93, supported on oblongated cylindrical backing 94, with grid markings 11*d* on 93. Markings 11*d*, virtue of the oblongated surface are spaced further apart than those on the hemispherical surfaces previously discussed. Surface 93 is in fact oblongated in the vertical but more true to the sphere in the horizontal. Impact markings on the ball will then be more readily read because of the greater spacing on the lines.

Referring now to FIGS. 12–19, there is shown further embodiments of the invention. Specifically with reference to FIGS. 12–14, there is shown golf ball 110 disposed on tee 111, with tape 112 encompassing the middle 131 of ball 110. Tape 112 comprises a top surface 114 and a bottom surface 113. A pressure-sensitive adhesive 115 is formed at bottom surface 113. Top surface 114 is formed with an impact marking material 116, such as NCR paper (see U.S. Pat. No. 3,754,764); carbon paper copyset, or other like materials which leave a mark when impacted by an object. The top surface 114 is imprinted with a centerline 119 and four spaced crossmarks or grids 120, for each member set or length 125. There are, of course, a plurality of member sets 125 on the tape, and each set is separated by perforations 126 so as to separate one member set from the other. The length of each member set between perforations is exactly equal to the circumference of the golf ball 110. Grids 120 are spaced so that when the perforated edges meet at 127 around the golf ball 110, the grids are each equally spaced 90° on the ball circumference. The tape is preferably one-half to one inch wide.

In utilizing the tape, a member set or length is removed from the elongated tape, and adhered around the circumference of the ball, with the perforated edges matching as at 129. The tape encompassed ball is then placed on the tee with one grid 120 in the top most position so as to be in view by the golfer, and the center line aligned by eye with the target, a second grid is then 90° from the first grid position and is in true position 131 to be struck by the golf club face. The user then strikes the ball leaving an impact mark, which once the ball is retrieved, the impact mark shows the deviation from grid 120 of position 131. The tape may be readily reused by marking the impact spot with a number and replacing the ball on the tee or ground and utilizing the same or another grid mark 120 at position 131.

Referring to FIG. 15, there is a further stick-on embodiment 133 wherein a plurality of horizontal 134 and vertical 135 grid lines are provided in addition to a plurality of concentric circles 136 about grid epicenter 137. Tape stick-on 133 provides a high degree of accuracy in determining the impact mark in relation to the epicenter 137. To insure a true impact mark, a plastic adapter 140 is provided (FIG. 16). Adapter 140 comprises a part spherical lower interior surface 141, upright flat sides 142, and a top surface 143 of flatter and of much larger radius than surface 141. An adhesive 144 is provided on surface 141 to insure a tight bond to surface 145 of golf ball 146. Stick-on 133 is adhesively applied to surface 143 so that the grid lines 134, 135 and 136 are laid out in a flatter disposition. In this manner the flat club face (not shown) strikes the flatter grid line markings surface and a more discriminating indication of the club face impact is recorded upon impact.

Referring specifically to FIG. 26, there is shown an alternate embodiment of afore-described adapter, namely, adapter 280. Whereas afore-described adapter 140 must travel in flight with the golf ball. This may be undesirable as effecting the ball flight pattern, and also in golf driving ranges where the player is not permitted to retrieve the ball from the range. The embodiment of FIG. 26 resolves these potential problems.

Adapter 280 in broad terms, is formed of flexible plastic so as to be temporarily affixed to golf ball 281 which adapter 280 is tethered by cord 282 to a fixed post (not shown) at the location at which the ball is driven. Once the ball is driven, the adapter is released from ball 281, and the ball continues in its normal flight pattern. The adapter being tethered is restrained from movement beyond the length of the tether. The player then retrieves the ball by pulling the tether.

In more specific terms, adapter 280 is formed of molded impact plastic having a part-spherical body portion 283 and upwardly and downwardly extending tapered flanges 284 and 284 downwardly extending flange 285 is formed with an outwardly disposed flange 286 having an eyelet 287 formed therein. Tether or cord 287 is securely tied to the flange 286 as at 287. Flanges 284 and 285 are tapered so as to form thin tip portions 284*a* and 285*a*, respectively. The interior 284 of adapter 280 is shaped to contour the ball 281. In this manner of construction, adapter 280 is lightly gripped or held to the ball, so that when struck by the golf club face the adapter tends to release from the ball, and is restrained by the tether.

Outer surface 290 of body portion 283 is imprinted or embossed with the afore-described grid markings 291. Alternatively, a web or tape with imprinted grid marks can be temporarily adhered to surface 290. Without the the tape the club face marker of FIG. 3 is employed, while with the tape a conventional club face is employed, and the reader of FIG. 19 used to determine the deviation.

Thus adapter 280 provides a low-cost, readily useful, alignment marking device, which is most suitable for golf driving ranges.

Referring now to FIGS. 17 and 18, there is shown a reader device 150 for utilization with the marker of the embodiment of FIGS. 12–14. Device 150 comprises a transparent plastic hemispherical portion 151 surrounded by a transparent flat flange 152. Portion 151 is sized so as to receive the golf ball 110 and encompassing tape 112 (FIG. 18). A plurality of protuberances 159 are formed between portions 151 and 152, and serve to retain ball in place. A plurality of horizontal lines 153, vertical lines 154, and concentric circles 155 are imprinted on portion 151. In addition a central circle 155 locates epicenter 156. Numerical designation 157 indicating the deviations, as discused in connection with the aforesaid embodiments. In addition, letter 158 indicates the direction of the ball flight in relation to the imprinted line.

In the aforesaid manner of construction, ball 110, having tape 112 thereon bearing impact mark 175 spaced from tape grid mark 120, is inserted within portion 151, and held in place by protuberances 159. The ball is then rotated so that mark 175 of tape 112 is aligned in epicenter 156 (FIG. 18). The grid 120 then lies under the visible grid portion of 151 to show grid markings thereby indicating the degree of deviation of arc and direction. It is also to be noted that, flange 152 forms an angle theta with the vertical 160, which flange angle dramatically demonstrates the club face angle at the point of impact of the club face with the ball.

It is to be borne in mind that the bottom flat surface of the flange of the hemispherical reader may be used as a marking guide-plate or template for the drawing of cross-hair grids or crossing 90° circumferential lines on the ball, as the ball alignment marks, prior to use of the ball for impact marking. By the term "hemispherical," "part hemispherical" is also within the scope of the term.

In FIG. 19, there is shown an alternative embodiment of the reader, which is formed of a transparent card 170 having a plurality of grid markings 171 similar to those of FIG. 17. To utilize card 170, the tape 112 is unwrapped from ball 110 and adhered to a flat surface 172. Card 170 is then placed over the tape, and the impact mark 175 is aligned with card grid epicenter 176. The tape grid mark 120 viewed through the transparent card then determines the deviation as indicated by the card grid markings.

It is to be noted that in respect to the transparent reader, the reader may be formed of molded or cast thermoplastic material, and imprinted by means well known in the art. In addition, the concentric circle portion of the reader may be formed as a convex element so as to provide a magnifying effect. Other magnifying elements are also within the contemplation of the present invention.

Referring now to FIGS. 20–25, there is shown an alternate embodiment of the present invention. In FIG. 20 there is shown golf ball 210 on tee 211 being disposed in turf 212, in the well-known conventional manner. A holder 213 is mounted adjacent to the teed-up ball 210. Holder 213 comprises a U-shaped portion 214 forming upright arms 215 and 216, cross-member 217 and a depending a spike 218 (FIG. 21). Arms 215, 216 are arcuately curved as at 220 so as to follow the curvature of ball 210. Spike 218 is driven into the ground so that curved arms 215 and 216 are adjacent to and minimally spaced several millimeters away from the surface of the golf ball, as at 220. A web 221 of a carbon paper set, is slidably received in grooves 222 and 223 of arms 215 and 216, respectively. Web set 221 is formed of an outer sheet 25 and inner sheet 226. Outer sheet 25 is a thin transluscent sheet imprinted on both sides 227 and 228 with a centerline 229 and grid making 230. Inner sheet 226 imparts a mark to surface 228 of outer sheet 25 on impact of the golf club face on surface 227. With impact, the holder and web move to contact the golf ball surface to impart flight to the ball, but the web and holder remain intact or moved only a slight distance from the initial spike location. With the impact mark left on surface 228, the inner sheet 226 is peeled away, and the mark location is noted in relation to the central grid mark. In addition the reader of FIG. 19 may be employed to give an accurate readout of the arc and direction deviations.

Referring now to FIGS. 23–25, there is shown an elongated strip 250 formed of a carbon set of two sheets 251 and 252, which strip 250 is formed so as to encompass the golf ball 260. Strip 250 is oversized to the circumference of the ball by overlap portion 261. The weight of the golf ball holds the strip down on tee 263. Strip 250 is imprinted with centerline 264 and grid marks 265 on both surfaces of the outer sheet. As aforedescribed grid marks 265 are equally spaced, in a manner similar to that of the embodiment of FIG. 12, but with the further addition of the overlap portion 261.

With the strip-enwrapped ball on the tee, the club face strikes the outer surface 268 of outer sheet 251, and flight is imparted to the ball. Then strip 250 unravels, and being aerodynamically unsuitable, falls to the ground near the point of impact. The marked top sheet is then stripped from the carbon backing and the position of the mark to the grid mark is noted. A card reader, as in FIG. 19, may be employed for accuracy.

Strip 250 may be formed as a plurality of strips in a tape 270, with each strip 250 being separated by perforation 271 for easy removal and accurate sizing of the strip.

It is also within the contemplation of the present invention to provide a web which is a single sheet and is temporarily held adjacent the ball surface, and on impact leaves an impact mark on the ball itself.

The embodiment of FIG. 1 describes the use of the alignment marking device with impact mark on the ball itself. With the impact mark on the ball, the hemispherical reader or locator may be employed. It was surprisingly found that the size of the circular impact mark was proportioned to the force of the club on ball at impact, and for any particular club face, the relationship of this force could be calculated to obtain the speed of the ball and then, in turn, an approximation of the distance of the shot. Thus the concentric circles of the hemispherical reader may be employed to provide an approximation of the distance of the shot, for any specific club; the larger the spot, the greater the distance of travel. This is important for practice-net drive shots, where the golfer cannot otherwise guage the distance of the drive.

It is to be borne in mind, that the strip 250 may be formed of any impact marking material and the invention is not to be limited to anyone embodiment such as a carbon paper set, NCR paper, or the like.

It is also important to note that the marking tape of the present invention is useful in and of itself without a locator or reader, although for more accurate determination, the reader is desired. The tape may only contain a centerline with arc and direction deviation determined in relation to the impact mark deviation from the centerline.

While the present invention is particularly useful to improve driving shots, it can as well be used to improve putting as well as fairway shots, such invention assisting the golfer in getting the head of his golf club squared to the intended line of ball path direction and aligned with the sweet spot or correct impact point on the ball.

It is to be understood that the forms of my invention herein shown an described are to be taken as preferred examples of the same and that various changes in the shape, size and arrangement of parts may be resorted to without departing from the spirit of my invention, or the scope of the subjoined claims.

What is claimed is:

1. A golf ball mark reading device comprising:

a transparent member, said member being formed with a hemispherical portion, said hemispherical portion being sized so as to rotatably receive a golf ball on the inside of the hemispherical portion, and the said hemispherical portion being formed with a central marking, and means formed on the hemispherical portion including a surface for determining the club face angle, so that a golf ball having an alignment marking thereon, for aligning the ball on the tee prior to club face impact and also having an impact mark caused by a golf club face impact on the ball adjacent said marking is placed within the inside of the hemisphere and rotated until the impact mark on the golf ball is aligned with the central marking of the hemisphere so that the center of the impact mark is determined and the surface of the means forms an angle with the alignment marking which angle indicates the club face angle at impact.

2. The device of claim 1, said means further comprising a flat portion extending outwardly from the hemispherical portion, so that with said impact mark center determination the flat portion forms an angle with the alignment marking which indicates the club face angle at impact.

3. The golf ball mark reading device of claim 1, said hemispherical portion being formed with means to retain the golf ball within the hemispherial portion with rotation, said retaining means comprising outwardly extending elements formed on and being disposed on the inside of said transparent member between said flange portion and said hemispherical portion.

4. The golf ball mark reading device of claim 1, further comprising a marking member, and said marking member comprising a tape for encompassing the ball, and said alignment marking being imprinted on the tape.

5. The golf ball mark reading device of claim 4, said alignment marking further comprising a cross-mark and a center line.

6. The golf ball mark reading device of claim 1, futher comprising a plurality of concentric circles disposed about said central marking.

7. A golf alignment marking device comprising:

a web, said web comprising means to impart a mark to a golf ball on impact of the web by a golf club face; and means to releasably hold said web adjacent the surface of a golf ball, so that on impact of the golf club face on the web, the impact mark is formed on the ball, and the web is released from the ball with the flight of the ball, and further comprising; a transparent member, said member being formed with a hemispherical portion, said hemispherical portion being sized so as to rotatable receive a golf ball on the inside of the hemispherical portion, and the said hemispherical portion being formed with a central marking so that a golf ball having an alignment marking thereon, for aligning the ball on the tee prior to club face impact and also having said impact mark is placed within the inside of the hemisphere and rotated until the impact mark on the golf ball is aligned with the central marking of the hemisphere so that the center of the impact mark is determined.

8. A golf ball mark reading device comprising:

a member, said member being formed with a portion, said portion being formed with inner and outer surfaces being sized so as to rotatably receive a golf ball on the inner surface of the portion, and the said portion being formed with a central marking, and means formed on the portion including a surface for determining the club face angle at impact on the golf ball, so that the golf ball having an alignment marking thereon, for aligning the ball on the tee prior to club face impact, and also having an impact mark caused by a gold club face impact on the ball adjacent said alignment marking placed within the inside of the hemisphere and rotated until the impact mark on the golf ball is aligned with the central marking of the hemisphere so that the center of the impact mark is determined and the surface of the means forms an angle with the alignment marking which angle indicates the club face angle at impact.

* * * * *